United States Patent [19]

Koptis et al.

[11] Patent Number: 4,827,855

[45] Date of Patent: May 9, 1989

[54] METHOD OF OPERATING A SMOKELESS PYROLYSIS FURNACE WITH RAMP AND SOAK TEMPERATURE CONTROL SYSTEM

[76] Inventors: Robert A. Koptis, 15963 Remora Blvd., Brookpark, Ohio 44142; Robert F. Heran, 1842 Donna Dr., Westlake, Ohio 44145

[21] Appl. No.: 208,372

[22] Filed: Jun. 17, 1988

Related U.S. Application Data

[63] Continuation-in-part of Ser. No. 881,953, Jul. 3, 1986, Pat. No. 4,751,886.

[51] Int. Cl.[4] ..... F23J 11/00

[52] U.S. Cl. ..... 110/345; 110/190; 110/214; 110/346

[58] Field of Search ..... 110/190, 236, 193, 210, 110/212, 214, 346, 345, 215

[56] References Cited

U.S. PATENT DOCUMENTS

| | | | |
|---|---|---|---|
| 3,807,321 | 4/1974 | Stockman | 110/236 |
| 4,181,081 | 1/1980 | Werer | 110/236 X |
| 4,557,203 | 12/1985 | Mainord | 110/190 X |

*Primary Examiner*—Edward G. Favors
*Attorney, Agent, or Firm*—Alfred D. Lobo

[57] ABSTRACT

A method of operating a batch-type pyrolysis furnace to burn organic combustibles so that the effluent from its exhaust stack is essentially free of smoke. This is accomplished without the aid of any catalyst or catalytic device to purify the smoke. For its main heat source, the furnace uses a gas burner or electric heating coil in combination with an afterburner to burn volatiles generated in the furnace's main chamber. A single thermocouple (throat TC) senses the instantaneous temperature in the throat of the furnace and in cooperation with a programmable controller (PC), maintains a preselected ramp and soak temperature profile over the entire burn cycle. When the temperature required by the profile is exceeded, a single water spray is actuated by a signal from the PC to lower the temperature below the profile. The throat TC thus maintains a fire under controlled temperature conditions in the main chamber without an explosion, using a single-stage system. This single-stage control system, for additional safety and redundancy, may include two back-up thermocouples, one in the main chamber (main chamber TC), and a second (stack TC) in the exhaust stack downstream of the afterburner. The main chamber TC senses the ambient, essentially instantaneous temperature at that location, and actuates the water spray system. The main chamber TC and the stack TC may each also attenuate the output of the main burner and control its on/off operation.

3 Claims, 3 Drawing Sheets

METHOD OF OPERATING A SMOKELESS PYROLYSIS FURNACE WITH RAMP AND SOAK TEMPERATURE CONTROL SYSTEM

CROSS-REFERENCE TO RELATED APPLICATION

This application is a continuation-in-part application of Ser. No. 881,953 filed July 3, 1986, now issued as U.S. Pat. No. 4,751,886.

BACKGROUND OF THE INVENTION

This invention relates to a control system for a batch-type pyrolysis device of the type used for volatilizing and burning organic material from a metal part to which the organic material is bonded. Incineration occurs in a zone adjacent to the device's main chamber in which the material is volatilized, but prior art devices are unable to provide a smokeless discharge into the atmosphere under normal conditions of commercial operation. By "discharge" we refer to combustion products issuing from the furnace's stack, and by "smokeless" we refer to the discharge being substantially clear to the naked eye, that is, permeable to light in the visible wavelength range.

Such an incineration zone is typically provided by an afterburner chamber in which an afterburner, positioned downstream of the device's main chamber in which pyrolysis occurs, burns the volatilized organic material (referred to herein as "vapor"). The remaining metal part is reclaimed for reuse because the cost of reclamation is less than that of making the metal part anew. Such reclamation by pyrolysis has evolved into a subindustry of considerable economic significance not only because pyrolysis is cost-effective, but also because incineration of the vapor of polymeric materials which are not economically recyclable, conveniently and beneficially disposes of them.

The vapor to be incinerated is generated when mounting means for engines and electric motors (collectively referred to as "motor mounts"), and similar steel parts bonded to rubber; or, copper-containing electrical parts such as armatures, stators, transformers and the like; or, painted ferrous or non-ferrous steel parts; or, metallic bodies of arbitrary shape which are coated with, or bonded to polymeric materials (referred to herein as "polymer-bonded metal parts"), are to be pyrolized in a pyrolysis furnace.

Polymeric materials to be disassociated from metal parts are such materials as are commonly bonded to a metal substrate or matrix and include natural and synthetic elastomers; for example, natural rubber and synthetic rubber which are polymers of dienes; silicones which are polymers of siloxanes and the like; and, natural and synthetic resinous materials including natural shellac and synthetic plastics such as phenolics and acrylics, particularly paints. The difficulty of incinerating the materials smokelessly varies; silicones do not burn smokelessly, but silicone-free rubbers and paints can now be reliably and economically incinerated, and smokelessly.

The foregoing polymeric materials are to be separated from the metal matrix to which they are bonded without melting the metal, and preferably, in most instances, without causing warpage or other undesirable deformation of residual metal matrix. It is self-evident that such separation may be effected by directly incinerating the polymeric materials, as is typically done in an incinerator for waste, but it is equally self-evident that the requirement of incineration without damaging the metal parts will not be met. Of course, damage to the parts can be minimized if only a few parts are incinerated together, but this method is undesirable because it does not lend itself to reclaiming a large enough mass of parts to be economical.

This invention is specifically directed to burning relatively large loads of metal parts combined with silicone-free polymers ("burnables") which are to be incinerated smokelessly in a relatively small main chamber, that is, with a relatively high ratio of load (lb)/volume ($ft^3$), referred to as the load/volume ratio. Such loads contain from 0.1 lb of burnables per lb of metal, to 2 lb burnables/lb metal, and are referred to as "high-polymer" loads in contrast to conventional loads which contain less than 0.1 lb burnables/lb of metal.

The term "pyrolysis oven" has been used in the art to indicate that there is no incineration of organic material on the metal parts within the oven's main chamber. The material is simply volatilized (or vaporized) without being burned in the oven's main chamber. The vapors are then burned in the afterburner chamber, but not before they have exercised the opportunity to plug water spray nozzles used to keep the volatilization of burnables in the main chamber under control. Such operation of a "pyrolysis oven", where there is no fire in the main chamber, is supposed to clearly distinguish its function, from that of a "pyrolysis furnace" in which there is. Nevertheless, the terms are often misused or interchanged, particularly in relation to devices using an afterburner in an afterburner chamber of the furnace, with no thought given as to the significance of where the fire is maintained.

The desirability of a smokeless dischrage from the stack of a pyrolysis furnace cannot be overemphasized. It is common practice to operate such a furnace during the day in such a manner that the smoky discharge is not too objectionable, reserving such operation for darkness. More responsible operators provide plural afterburners in series to make sure that as complete combustion as possible is obtained. The seriousness of the problem is such that even in a drying furnace where a relatively small amount of contaminating oil is being burned, plural burners are used, as disclosed in U.S. Pat. No. 3,767,179 and 3,3839,086 to Larson.

Where the weight ratio (weight of burnables to be burned): (weight of metal) is relatively high, that is in the range from 0.1:1 to 2:1, a manufacturer of a prior art furnace advises against burning such loads. Attempts to burn even a small load result not only in the discharge of a highly noticeable stack gas, but also in the severe fouling of the furnace's main chamber, the controls, and, most important, of the water nozzles upon which the safe operation of the furnace is critically dependent.

An attempt to deal with the problem of fouling water spray nozzles is found in U.S. Pat. No. 4,557,203 to Mainord who uses a first sensor in the stack downstream of the afterburner to actuate a first set of nozzles; and a second sensor in the main chamber to actuate a second set of nozzles.

A highly successful control system for a pyrolysis furnace in which incineration occurs in the main chamber and also downstream of the afterburner is provided in copending application Ser. No. 822,022 filed Jan. 26, 1986. This system uses a single water spray system controlled by a first thermocouple in the main chamber (main chamber TC), and another (third) thermocouple (throat TC) in the vent passage ("throat") connecting the main chamber to the afterburner chamber. A second thermocouple in the stack (stack TC) controls only on/off or attenuated operation of the main burner. The effectiveness of this control system, in large measure, derives from the difference in temperatures sensed by the first and third thermocouples.

It was found that with high-polymer loads loads with the above-specified burnables content, the rise of temperature in the initial portion of the burn cycle was often uncontrollable, resulting in dense smoke and excessive temperatures in the main chamber. This occurred even when the furnace is constructed with a "vent number" greater than 0.003/ft found to be critical for normal operation. The vent number is computed by dividing the area of the vent (throat, $ft^2$) by the volume of the main chamber ($ft^3$).

It was not then realized that the sensitivity of the throat thermocouple is such that, a controlled rate at which the temperature of the load is raised ("ramped") can control a burn so effectively as to provide a smokeless stack even when burning a load of high-polymer parts. And most important, that the entire burn cycle may be controlled with the throat TC, so that the main chamber TC and the stack TC are used to provide redundant safety of operation.

This invention is specifically directed to a pyrolysis furnace with a single afterburner in an afterburner chamber, in which furnace a fire is sustained in the furnace's main chamber, while the temperature is ramped to preselected progressively higher set-points with intervening soak intervals, after which the temperature is maintained constant during a final load-cleaning burn (refered to as the "final soak period"). The surprising result is that there is essentially no visible smoke issuing from the stack, and no runaway increase of temperature.

A charge of metal parts on a cart is charged to the main chamber, the charge is brought up to ignition temperature at a predetermined rate which is controlled by a programmable control means, ignited, and the fire sustained under controlled "ramp and soak" conditions until the charge is burned out.

It is known that heating of the metal parts to 700°-800° F. in an enclosure with limited air intake will char or degrade all known combustible contaminants without ignition if the percentage of contaminants is less than about 2% by weight ("wt") of the parts. However, we are concerned with igniting much higher amounts of combustibles in the range from about 10% by wt of the load in the charge to about twice the weight of the load, or even more, and it is critical that the ignition result in an essentialy smokeless stack.

It is unnecessary to point out that, when operating under near-explosive conditions and a very small misstep can set off an explosion, a smokelesss stack may be an exiguous consideration. But any control system which provides a smokeless stack, yet prevents such an explosion from being set off, acquires great merit. In other words, a smokeless furnace must be operated with no sacrifice of safety. Our invention does so.

A reclamation oven with a control system for preventing fires and explosions and thus controlling excess temperature within it, is disclosed in U.S. Pat. No. 4,270,898 to Kelly. The fire and explosion control method senses a fire situation before it occurs, and keeps the fire from happening by instituting a timely extinguishing system. A thermocouple is installed in the exhaust, downstream from the afterburner, and when the temperature exceeds a preset temperature, a signal from the thermocouple actuates an automatic valve assembly to open it and spray water onto the too-hot parts in the main chamber. When the parts cool sufficiently, the valve assembly closes. The system prevents fires and explosions and thus controls excess temperatures. The main burner is not shut off when the water spray comes on, though the main burner goes off when the oven reaches the set-point temperature, nor is the average temperature above the metal parts in the oven's main chamber (referred to as the "ambient temperature" in the main chamber) monitored. The prior art system in which a fire in the main chamber is prevented, is wholly ineffective to minimize the smoke issuing from the stack, and as Mainord states, is responsible for plugging water nozzles. It is quite unlike our system in which a fire is maintained under conditions imposed by alternately ramping temperature, then maintaining it constant ("soaking").

Another system relating to incineration of unwanted organic material such as oil associated with metal parts, particularly scrap or swarf, is disclosed in U.S. Pat. No. 3,705,711 to Seelandt et al. Only as much air and fuel as is required to fuel the main burner, is burned to minimize oxidation of the metal parts and to minimize the risk of explosion. It is evident that such conditions of operation are calculated to generate more smoke because of incomplete combustion, not minimize the smoke generated. Control is provided by limiting the amount of combustion air to the main chamber when a preset pressure is exceeded. It is suggested that the temperature within the drum may first be lowered by throttling back the main oil burner or by stopping the feeding of metal scrap into the dryer drum. When the main burner output is reduced to its lower limit and the temperature within the drum is still too high, a water spray may be actuated. Should the spray be insufficient to lower the temperature, the feeding of the scrap into the drum is reduced or stopped. The problem is that the time period required for these operations is much longer than that permitted by conditions under which an explosion occurs because of ignition of the built-up vapor. As a result, such a system is wholly unsatisfactory under the conditions of operation of a pyrolysis furnace.

The control system of our invention allows the safe and smokeless burn of a high-polymer load by controlling a single stage of the burn cycle, namely the ramping stage. Control of the temperature in the throat to track the ramp and soak profile with an intermittent water spray, is the only essential and critical requirement of our single-stage system. No prior art control system for a pyrolysis furnace recognized the importance of a controlled temperature ramp, or ascribed any significance to, or suspected a correlation between the ramp controlled by a throat TC in cooperation with a PC, and a smokeless discharge.

The efficacy of our system is predicated on the discovery that the throat is the critical location in the furnace, at which single location, it is critical that we control of the rate at which the temperature in the main chamber is increased. Such control serves a double-barreled purpose—it provides a safe burn, controlled with a water spray, and it provides a smokeless stack gas.

SUMMARY OF THE INVENTION

It has been discovered that by controlling the ramping of temperature in the main chamber of a pyrolysis furnace, and the duration of any subsequent soak period, with a single thermocouple in the throat of the furnace, it will produce a smokeless stack gas with no sacrifice in operational safety, when it is fired by a main heat source and an afterburner burning in the presence of excess oxygen. A programmable controller means sets the ramp, that is, the instantaneous critical temperature in the throat as a function of time, and actuates a water spray at any time when the temperature required is exceeded.

More specifically, it has been discovered that excellent operational safety and a smokeless stack are provided by controlling a single stage, namely the ramping stage, of a burn cycle with a throat TC. For additional safety, the furnace is preferably equipped with three thermocouples, one (first) in the main chamber (main chamber TC), a second in the exhaust stack downstream of the afterburner (stack TC), and a third upstream of the afterburner in throat (throat TC). The main chamber senses the ambient temperature near the top thereof. The effectiveness of the control system derives from the critical placement of the throat TC, and its resulting effectiveness to control the ramping portion of the burn cycle which unexpectedly also provides a smokeless burn.

It is therefore a general object of this invention to provide, in a pyrolysis furnace having a main chamber, a main gas burner directly to heat air ducted into the chamber, a throat near the top of the main chamber through which throat organic vapor volatilized by incineration of polymer-bonded metal parts leaves the main chamber, an afterburner chamber provided with an afterburner to incinerate said organic vapor downstream of the throat, an exhaust stack through which incinerated vapor is vented, a main chamber TC located within the main chamber, near the top thereof, to sense the ambient temperature of gases above the metal parts within the chamber, and, a stack TC located in the exhaust stack downstream of said afterburner, the improvement comprising, a throat TC located in said throat upstream of said afterburner, to sense the instantaneous critical throat temperature;

programmable temperature control means which requires a predetermined temperature ("required temperature") as a function of time operatively connected with said throat TC; and, water spray means responsive only to said throat TC when the temperature in the throat exceeds said predetermined instantaneous critical throat temperature in the range from about 600° F. to 1100° F. at a predetermined time, so that water is sprayed into a zone above said metal parts to lower the throat temperature to said required temperature;

whereby said incinerated vapor leaving said exhaust stack is permeable to light in the visible wavelength range.

It is a specific object of this invention to provide a pyrolysis furnace with a smokeless stack by (i) maintaining a fire in a high-polymer load of metal parts being pyrolized under a controlled ramped temperature during the initial stage of the burn cycle, which temperature is sensed by a throat TC, and obtaining a required temperature as a function of time, (ii) sensing the stack temperature (with a stack TC) downstream of the afterburner, which stack temperature, if exceeded, shuts off the main gas burner, and, (iii) sensing the ambient temperature in the main chamber (with a main chamber TC), which ambient temperature, if exceeded, actuates a water spray in the main chamber to cool the burning load, so that combustion gases from the stack are essentially smokeless.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the views and in which.

DETAILED DESCRIPTION OF PREFERRED EMBODIMENTS

The most preferred embodiment of the invention derives from the use of a programmable controller means("PC") to provide a predetermined controlled temperature ramp in a temperature profile monitored by a TC in the throat. The required ramp may consist of a single ramp, or plural ramps, and the one or more ramps may be executed with no soak periods, if a soak period is unnecessary, or plural soak periods. It is preferred to use a PC with about 4 ramps and 4 soak periods, though a particular profile may use only a single ramp and from 0 to 4 soak periods. It is critical that the sensing means for the ramp profile be in the throat. In addition, the furnace is constructed with an adequate vent number to minimize the risk of explosions, as was disclosed in our copending application Ser. No. 822,022.

Figure 1:
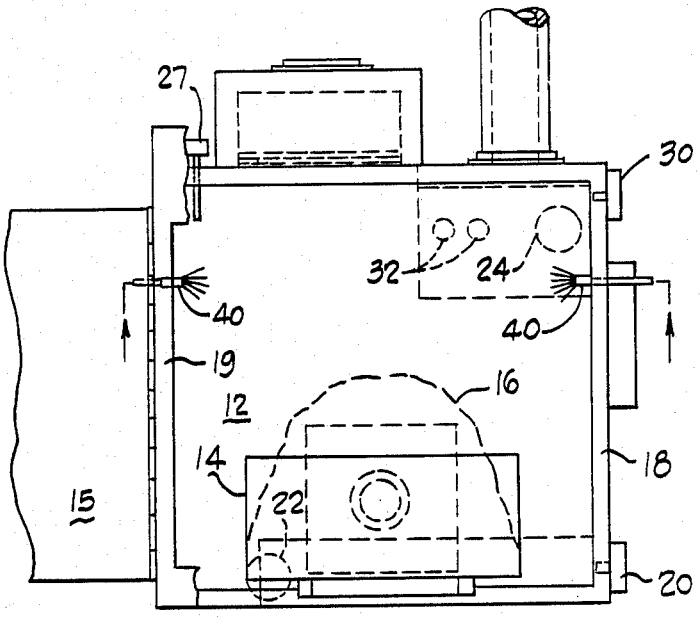
FIG. 1 is a front elevational view of a schematically illustrated pyrolysis furnace, with an open front door shown broken away, the operation of which furnace is controlled by the two-stage temperature control system of this invention.
Figure 2:
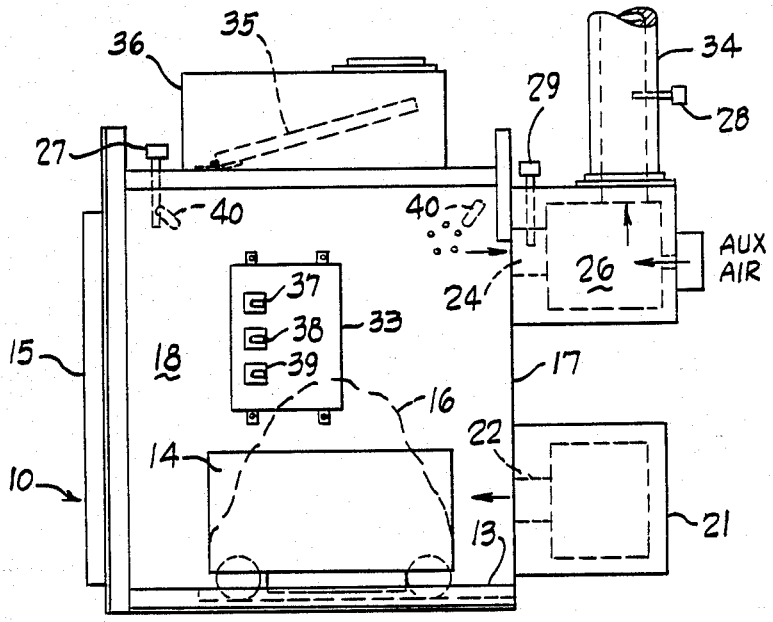
FIG. 2 is a side elevational view of the furnace showing the preferred locations in the furnace of the three thermocouples essential to the effective operation of the furnace with the control system.

The furnace and control system for its operation is diagrammatically illustrated in FIG. 1 which is a front elevational view of a pyrolysis furnace, indicated generally by reference numeral 10, which is typically a large structure shaped like a rectangular parallelpiped though the shape is not especially relevant to the function of the furnace. Within the furnace is a main chamber 12 onto the floor 13 of which a cart 14 is rolled through a door 15. The cart is loaded with polymer-bonded metal parts 16 to be pyrolized. The door 15, shown in the open position with a portion broken away, is in the front of the furnace which has a rear wall 17, right side wall 18 and left side wall 19. The door is gasketed with a suitable high temperature material to seal the main chamber during operation, and the interior surface of the door, like the interior of the main chamber, is insulated with ceramic fiber. After one load or charge is subjected to a pyrolysis or "burn-off" cycle, another is introduced into the chamber and the cycle is repeated, which is why the furnace is referred to as a "batch" pyrolysis furnace.

At the far end of the chamber from the door, and behind the rear wall, is provided a direct heating means for air in the form of a main burner assembly, indicated generally by reference numeral 20, which includes a main burner removably inserted in a main burner firebox 21, air regulating means (not shown) to adjust the air flow to the burner, and associated hardware (not specifically shown) all of which is conventional and commercially available. The particular type of direct heating means for supplying hot air is not critical so long as it can provide enough heat to ignite the polymer on the metal parts once they have been brought up to temperature in the main chamber. Most preferred is a main burner which burns natural gas fuel to produce an elongated flame which is adjusted to extend along substantially the entire length of the base of the rear wall 17 of the chamber. Hot combustion gases generated by the main burner flow into the main chamber through a burner passage 22 in rear wall 17. The burner passage 22, places the main chamber in open communication with the main burner firebox. The flame is adjusted to extend the length of the firebox with the tip of the flame playing at passage 22, the cross-sectional area of which is substantially the same as that of the sheath so that there is no significant restriction of circulation of the hot gases generated by the main burner. This ensures igniting the charge after it reaches ignition temperature.

The type of main burner chosen depends upon the size of the charge and chemical composition of the polymer to be "burned", and the time constraints for doing so. For a typical main chamber having a width of 4 ft., a length of 4 ft., and a height of 4 ft., within which a charge of about 500 lb of motor mounts (20% by wt is rubber) are to be burned, an Adams Model 225 burner having a rated output of 100,000 BTU/hr is used. The load/volume ratio is about 7.8 lb/ft$^3$; and the burnables/metal ratio is 0.25. Operable load/volume ratios range from about 0.5 to about 15 lb/ft$^3$, it being readily realized that the lower ratio is not narrowly critical while a ratio higher than the upper ratio leads to an inoperative furnace.

This burner may be adjusted to throw a flame about 3 ft long, and the air intake to the burner can be controlled to ensure that the fuel burns with an excess of oxygen.

In the rear wall 17, and near the top thereof, diagonally from the burner passage 22, is a throat 24 through which hot gases generated in the main chamber leave it. The throat 24 places the main chamber 12 in open communication with an afterburner chamber 26 in which an afterburner assembly 30 is removably inserted. The assembly 30 includes an afterburner, means for regulating the amount of natural gas burned, means for regulating the air flow to the burner, and associated hardware (not specifically shown) all of which are commercially available, for example in an Adams HP BPS burner (output 400,000 BTU/hr) assembly. The afterburner is adjusted to throw an elongated flame. All gases which leave the main chamber must flow through the throat 24 and come in contact with the afterburner flame in the afterburner chamber.

The diameter of the throat 24 is sized so as to provide a predetermined draft, whether natural or forced, in the main chamber during operation of the furnace. The type of polymer burned, the weight of polymer present on each charge, the volume of the main chamber, and the time in which each cycle is to be completed (that is, the charge is to be introduced, brought up to temperature, burned and cooled enough to withdraw the cart from the main chamber), inter alia, will determine the area.

In particular, when the mass flow rate of hot gases and vapor through the throat 24 exceeds a critical venting flow rate there is a rapid build-up of pressure, which build-up, if continued, results in an explosion. To avoid the explosion, the quantity "(area of the throat 24)/(volume of the main chamber 12)" must exceed 0.003/ft but preferably not exceed 0.015/ft. This quantity is referred to as the critical vent number.

For example, a furnace with a 4'(ft)×4'×4' main chamber required to burn a charge of about 500 lb of motor mounts consisting of 400 lb of steel and about 100 lb of rubber in a 6 hr cycle, requires a vent larger than 0.5 ft in diameter. The vent is too large when a desirable draft to ensure good flow through the stack cannot be maintained. An operable vent diameter is in the range from 8" (inches) to 10".

The afterburner chamber is provided with adjustable auxiliary air vents 32 through which fresh air is introduced to supply the necessary oxygen for complete combustion of the vapor flowing through the flame of the afterburner. The combustion gases from the afterburner chamber 26 flow upwardly through a stack 34 and are vented to the atmosphere.

As already pointed out, our system relies on sustaining a fire under controlled conditions in the main chamber so as not to trigger an explosion. However, to complete a "burn" of the charge within a few hours, usually from 4 to 6 hr, and generally no more than 8 hr, each cycle is completed within a period close to the minimum. Under such conditions the risk of an explosion is increased. Accordingly, as a precautionary measure, the furnace 10 is provided with an explosion control escape hatch 35 shown in phantom outline in an open position, and an escape hatch enclosure 36 which is vented to the atmosphere through a stack (not shown).

Under such conditions, we discovered that not only is there a surprising difference in the ambient temperature in the main chamber 12 and that in the throat 24, but that controlling the temperature in the throat is critical to prvoide a smokeless, yet controlled and explosion-free burn.

Though we know of no single criterion for anticipating when an explosion will occur during a cycle, we have found that programming the controlled upward ramping of temperature, optionally with intermediate soak intervals, avoids an explosion while incinerating a high-polymer load smokelessly.

It is essential to provide only a single throat TC 29 (T/C-3 in FIG. 4) in the throat 24 which senses the instantaneous temperature and conveys an electrical impulse corresponding thereto to the PC which controls the progression of temperature (that is, the temperature profile of the ramp and soak periods over a single cycle) in the throat. Actuation of the water spray, as well as attenuation or on/off operation of the main burner sufficient to have the temperature sensed in the throat conform to the profile, and therefore, the entire progress of the burn, may be controlled by the throat TC 29 in conjunction with the PC.

Since it is generally desirable to know the ambient temperature in the main chamber, a main chamber TC 27 (T/C-1) is placed in the main chamber near its ceiling, and to provide redundant safety, may be used as a back-up to attenuate the output of the main burner, or to control its on/off operation, as well as to actuate the water spray.

Also for information, a stack TC 28 (T/C-2) is placed in the stack just downstream of the afterburner chamber 26 to monitor the stack temperature, and to provide redundant safety, may be used as a back-up to attenuate or shut off the main burner when the stack temperature is exceeded, and turn the burner on when the temperature reverts to normal.

The TCs transmit signals to plural control means 37, 38 and 39 mounted on an electrical panel 33 wall, shown mounted on the right side wall 18, but only T/C-3 controls the burn-out of a charge as described hereinafter, since the back-up TCs are optional.

By controlling only the ramped temperature, that is, the instantaneous temperature sensed by T/C-3 as a function of time, we are able to monitor, the instantaneous mass flow of vapor and combustion gases through the throat. When the temperature sensed by T/C-3 exceeds a predetermined temperature at a particular instant, (that is, the temperature lies above the profile or gradient of the programmed ramp and soak progression set by the PC), an appropriate reduction of the temperature is called for by the PC. A commercially available PC for the purpose is a West 2050 Series available from Gulton Industries, Inc.

The PC actuates a water spray means which sprays water on the burning load through nozzles 40 disposed within the main chamber, near the top thereof. If the temperature nevertheless exceeds a pre-set deviation which is above the profile of the ramp programmed by the PC, a further reduction in temperature is effected by a signal from the PC which actuates means for attenuating the main burner.

If a PC is used which is not equipped with the requisite means for actuating the attenuation or on/off control of the main burner, this may be effected independently of the PC, namely, by the main burner TC (T/C-1) operatively connected to control means for attenuation or on/off control of the main burner.

More specifically, in the most preferred embodiment, control of the temperature in the main chamber is effected by a PC programmed to control a "ramp and soak" profile of temperature as sensed by the throat TC, independent of any other sensing means.

In a particular embodiment, a ramp and soak profile for a burn cycle may include (i) an initial soak period (referred to as $Dwell_i$); followed by (ii) a ramp which may, or may not be interrupted by one or more intermediate soak periods (referred to as $Dwell_{m1, \ldots m4}$); and, conclude with (iii) a final soak period (referred to as $Dwell_f$).

Typically, the PC is programmed for an initial soak temperature $T_i$ in the range from 600°–800° F. (say 650° F.) and the $Dwell_l$ is set for a preselected period in the range from 5 min to 30 min. The particular length of period for an initial soak is set by trial and error such as an operator is accustomed to do. Thereafter a ramp is set to raise the temperature from $T_i$ (650° F.) through a temperature gradient to $T_m$ (say 950° F.) with a $Dwell_m$ set for a period in the range from 3 to 10 hr (say 5 hr), then maintained at a final burn temperature $T_f$ in the range from 900°–1100° F. (say 950° F.) at the end of the ramp for a soak period ($Dwell_f$) set in the range from 2 to about 8 hr (say 5 hr). The precise periods and temperatures for the one or more ramps, and the initial, intermediate and final soaks, if such are desired, is set by trial and error, depending upon the type of load to be burned, the heat duty of the main burner and afterburner, and other variables.

If preferred, the ramp from $T_i$ to $T_m$ may be divided into one or more stepped intervals, allowing for a predetermined soak period $Dwell_{m1}$, $Dwell_2$, etc. at each intermediate temperature $T_{m1}$, $T_{m2}$ etc.

Figure 3:
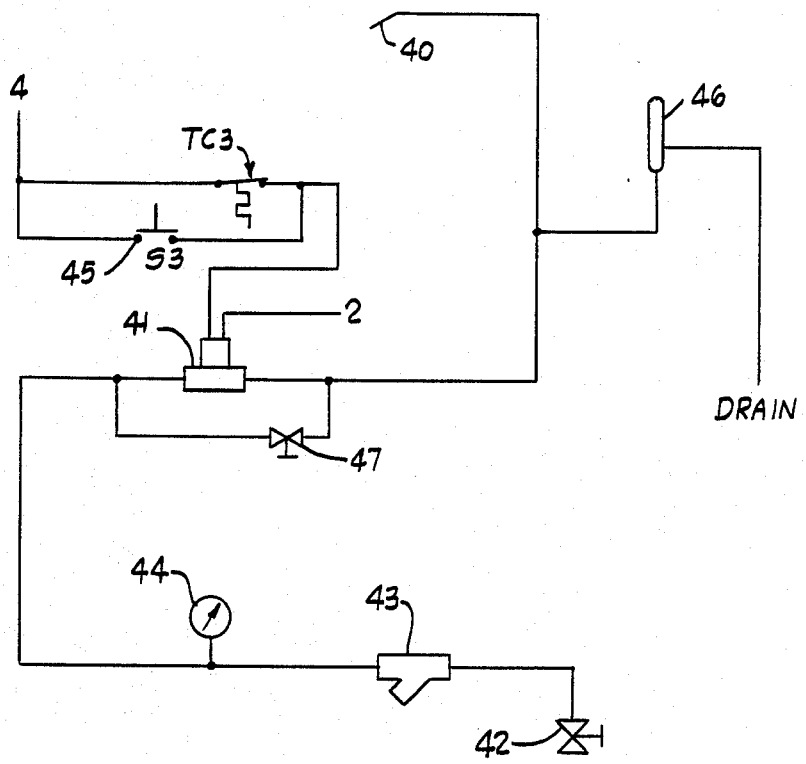
FIG. 3 is a diagrammatic illustration of a piping system for a water spray actuated by the control system for the furnace.

If the temperature set by the ramp profile is exceeded, a signal from the PC turns the water spray on. A single water spray system is used in which the spray nozzles' combined output depends upon the size of the main chamber, the size of a normal charge to be burned, and the amount of polymer to be burned. An additional second water spray means may be used, if desired, operated by the main chamber TC, for the sake of additional safety, but is generally unnecessary. Less than 1 gpm of water is typically adequate, from about 0.25–0.5 gpm being most preferred. The piping of the water system is schematically illustrated in FIG. 3 along with a portion of the electrical circuit for control of the solenoid 41.

Water from a water supply line under normal pressure of about 50 psig flows through gate valve 42 which is always open, then through strainer 43, and is stopped at the normally closed solenoid 41. A pressure gauge 44 senses line pressure. If the water pressure exceeds 175 psig it is relieved by a poppet type pressure relief valve 46. Upon signal from the throat TC 28 (T/C-3) the solenoid 41 opens and water is sprayed through the nozzles 40. When the temperature falls sufficiently, the water spray is stopped. The operation of the spray may be checked with a manual toggle switch 45 as will be explained in the description of the circuit diagram. A bypass valve 47, may be manually opened to bypass the electrically operated solenoid valve and provide a spray, if desired.

When the furnace is started, a relay in the burner is energized to start the blower motor. This closes the centrifugal switch on the motor and energizes the electronic ignition system. After a short delay, both the pilot valve and ignition are energized. Once the pilot is proven, the ignition is shut off and within one second the main valve opens. This is also the sequence when the main chamber temperature control calls for heat and the relay in the burner is energized to start the blower motor. The afterburner stays on high fire for the complete cycle. When the set point on the main burner temperature control is reached, the main burner goes off. The relay coil, main gas vlave on the burner, and the pilot valve on the main burner are de-energized.

Figure 4:
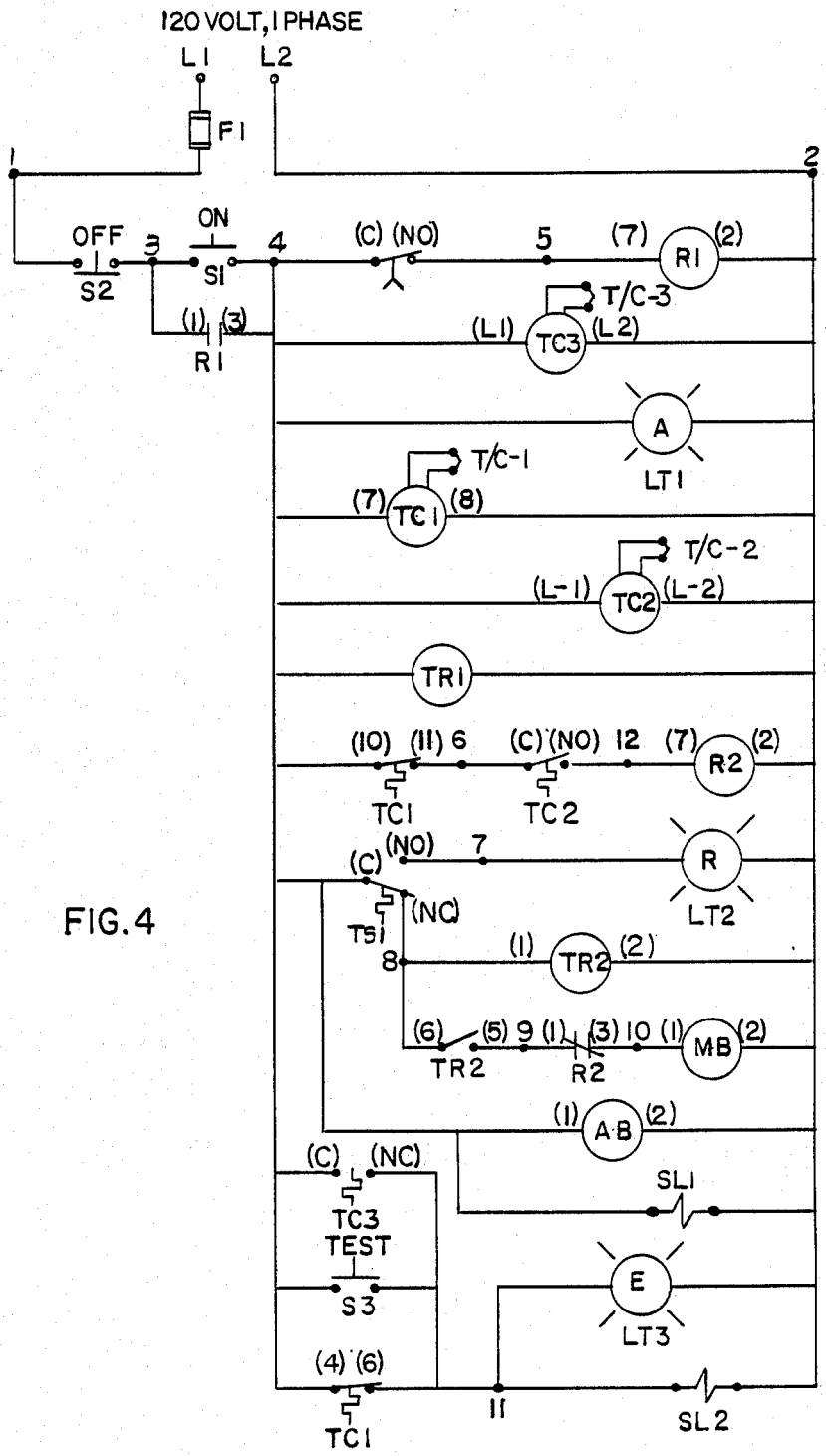
FIG. 4 is an electrical schematic for the control system.

Referring to FIG. 4 there is shown a diagram for an electrical circuit for operation of the furnace with 120 volt (single phase) power supplied to terminals L1 and L2, the latter being neutral.

With power at #4 the PC and thermal switches AB and MB are energized and the cycle timer is used to activate the circuit. The cycle timer motor TR1 is now operating and the temperature controller TC1 (7 & 8), has power supplied to one side of it. The gas shut-off solenoid SL1 will also be energized and actuate the gas valve (associated with the solenoid) to open it (the valve). The afterburner AB (1 & 2) will also be energized, go through its ignition sequence, and light up. The afterburner AB and gas solenoid SL1 will remain ON for the rest of the cycle.

As long as the furnace temperature remains below 1200° F., which is a preset temperature, power will flow through MB over-temperature control TS1 (C & NC). At this time the afterburner preheat timer motor TR2 (1 & 2) will start operating. When the 10 or 15 minute AB preheat cycle is over, AB preheat timer contacts TR2 (6 & 5) close. With this contact (TR2) closed, power is supplied to main burner relay contact R2 (1 & 3). When this contact R2 (1 & 3) is closed the main burner MB (1 & 2) will be energized, go through its ignition sequence, and light up. When contact R2 (1 & 3) is opened, the main burner MB (1 & 2) will be de-energized and go off.

When the furnace temperature exceeds 1200° F., MB over-temperature control TS1 contact (C & NC) will open and deenergize the main burner MB (1 & 2). Over-temperature control contact (C & NO) will close and the red high limit (over-temperature) light LT2 comes on. If, after having exceeded the preset temperature of 1200° F. the furnace temperature drops below 1200° F., MB over-temperature control TS1 must be manually reset. When switch TS1 is reset, contact (C & NO) opens and turns off the red over-temperature light LT2. Contact (C & NC) closes and supplies power to afterburner preheat timer TR2.

The main burner is controlled by the main burner temperature control TC1 (10 & 11) and the exhaust stack temperature control TC2 (C & NO). Thermocouple T/C-1 is located in the furnace's main chamber to measure ambient temperature. Thermocouple T/C-2 is located in the exhaust stack. When the temperatures in the main chamber and the exhaust stack are below a predetermined setpoint, power is supplied to the main burner relay coil R2 (7 & 2). When the relay coil R2 is energized, the main burner relay contact R2 (1 & 3) closes. If the temperature in the main chamber or exhaust stack exceeds the preset point, the main burner relay coil R2 (7 & 2) is de-energized and mainburner relay contact R2 (1 & 3) opens.

The water spray system is controlled by TC1 (4&5) and water spray temperature control PC (5 & 4). Thermocouple T/C-3 is located in the throat 24 and is connected to the PC which is programmed with a $Dwell_1$ of 15 min. at 650° F.; a ramp from 650° F. to 950° over a period of 5 hr with no $Dwell_m$ because there are no intermediate soaking steps so that the profile of the ramp is a straight line with a gradient of 300° F. over 5 hr; and a $Dwell_f$ of 5 hr at 950° F.

When the temperature in the throat exceeds a point on the ramp and soak profile as set in the PC, the spray system solenoid will be energized, the red light LT3 goes on and the water valve associated with the solenoid is opened. Water is sprayed in a mist (or, finely divided stream of droplets) until the temperature in the throat and that in the main chamber drops below the set point and the water solenoid is de-energized. Closing the contacts for switch S3 manually will also energize SL2 and turn on the red light LT3.

The PC is provided with one or more set points corresponding to a deviation(s) which may be pre-set. For example, a first deviation of 25° F. is set in the PC which deviation is maintained over the profile of temperature of the entire cycle, so that if the temperature sensed by T/C-3 exceeds the instantaneous temperature on the profile by 25°, an additional event to help cool the load may be set-off. The main heat source (burner or electric resistance heating coil) may be shut off, or a second water spray (not shown) may be actuated. If two set-points are provided for two deviations, one deviation may be set for 25° F. (say) to actuate the second water spray, and the other deviation may be set for 50° to shut off the main heat source, or to trigger an alarm. Still another alternative is to use a single set-point for a deviation to actuate the second water spray as well as shut off the main heat source.

At the end of the cycle, the cycle timer contacts TR1 (C & NO) will open and de-energize hold in relay coil (7 & 2). When the hold in coil is de-energized, the hold in relay contacts R1 (1 & 3) will open. With this contact R1 open, there will be no power supplied to terminal #4 and the electrical circuit is de-energized.

Though the heat source referred to hereinabove has, in the main, been a gas burner, an electric heat source such as resistance heating rods of nickel-chrome alloy sheathed with Inconel may also be used with surprising effectiveness provided they glow red hot at sufficiently high temperature to ignite the vapors generated by the load. Typically, the heating rods are operated with an on/off switch to heat the load with a predetermined ramp, with or without a preliminary soak. The advantage of the heating rods is that the load may be brought up to the final soak temperature more quickly than with a main gas burner. In other words, the load may be burned with no preliminary soak and with a steeper gradient of the ramp.

In the following illustrative examples, the pyrolysis furnace of this invention has a conventional stack without a catalyst or burner in the stack to minimize the discharge of smoke from the stack. It will be recognized that smoke can be purified by the catalytic action of a device mounted in the flue, as for example shown in the catalytic furnace disclosed in Japanese patent No. 157715 to Takahashi. The furnace we use has a 4 ft×4 ft×4 ft main chamber and utilizes no catalytic smoke purification means in the exhaust stack.

EXAMPLE 1

A load of stainless steel tops and bottoms of syrup cylinders for soft drinks are pyrolized to burn off the rubber cushions bonded to the steel. The rubber cushions have an average thickness of about 0.25 inch, and there is about 1.5 lb of rubber on each piece.

The total weight of the load charged is 43 lb before the burn is initiated, and 59% of the load is combustible rubber. After the burn, the weight of the clean steel is 17.5 lb.

The main chamber first ramp setting is 600° F. and a continuous ramp is set for a final temperature of 800° F. over a period of 3 hr. After the ramp to 800° F. the load is burned for an additional 3 hr period (dwell). The throat TC is set for 1000° F.; the stack TC is set for 1700° F. The water spray comes on when the throat temperature exceeds 1000° F. The rubber is vaporized and burned completely at the end of the 6 hr cycle with essentially no generation of visible smoke in the effluent from the stack.

When the combustibles in the load is less than 20%, setting a ramp may be unnecessary. The ramp is nevertheless desirable for safety, and particularly for loads in which the combustibles are highly flammable, for example, nitrocellulose-based painted articles.

The burn proceeds from start to finish with essentially no emission of smoke from the exhaust stack during combustion of the combustibles.

EXAMPLE 2

In a manner analogous to that described in the foregoing example, a load of 100 paint hooks having about 25% by weight combustible epoxy primer and paint non-uniformly coated on each of the hooks, is charged to the furnace. The weight of the load to be burned is 130 lb. After the burn, the clean hooks weigh 97 lb indicating that 33 lb are burned, an average of 0.33 lb per hook.

The first setting for the ramp is 500° F. and the top temperature of the ramp is set for 800° F. to be ramped continuously over 1 hr. The dwell is set for an additional 2 hr so that the cycle time is 3 hr. The throat TC and the stack TC are set at 1000° F. and 1700° F. respectively, as before.

The burn proceeds from start to finish with essentially no emission of smoke from the exhaust stack during combustion of the combustibles.

EXAMPLE 3

In a manner analogous to that described in the foregoing example, a load of 200 lb stators having about 25% by weight combustible insulating organic varnish is charged to the furnace. After the burn, the cleaned stators weigh 175 lb indicating that 12.5 lb varnish is burned.

The first setting for the ramp is 600° F. and the top temperature of the ramp is set for 800° F. to be ramped continuously over 1 hr. The dwell is set for an additional 2 hr so that the cycle time is 3 hr. The throat TC and the stack TC are set at 1000° F. and 1700° F. respectively, as before.

The burn proceeds from start to finish with essentially no emission of smoke from the exhaust stack during combustion of the combustibles.

From the foregoing description of the best mode of operating the furnace it will be seen that (a) providing a smokeless stack even when burning a high-polymer load, and (b) avoiding an explosion are predicated on sustaining a fire in the mass of parts in the main chamber and closely controlling the temperature in the throat to track a predetermined temperature profile of ramp and soak periods required by the PC. The effectiveness of the control system is based on control of the ramp and soak periods by the PC operatively connected with the throat TC. Because the sensitivity of the throat TC was not known, its effect on controlling the smokeless operation of a pyrolysis furnace safely was not appreciated.

We claim:

1. A method for operating a pyrolysis furnace with essentially no visible smoke emanating from its stack, without catalytically converting gases in said stack, said pyrolysis furnace having a main chamber and a throat near the top thereof, said method comprising, (i) maintaining a fire in a high-polymer load of metal parts in the furnace's main chamber, said parts being pyrolized under a controlled predetermined temperature profile including a progressive increase of temperature as a function of time, (ii) sensing the temperature in the throat with a throat TC and obtaining a required temperature as a function of time, and, (iii) actuating a water spray when said required temperature is exceeded, to cool said load to a temperature below said profile; so that combustion of said polymer is so complete that products of combustion from the stack are essentially smokeless.

2. The method of claim 1 including, sensing the temperature within said main chamber near the top thereof, to sense the ambient temperature of gases above said metal parts therewithin;

sensing the temperature in said stack; and, spraying water into a zone above the load in said main chamber when the temperature in said throat exceeds a predetermined instantaneous critical temperature in the range from about 600°–1100° F., so as to lower said throat temperature below said required temperature.

3. The method of claim 2 wherein the ratio of the weight of the load (lb)/volume of the main chamber ($ft^3$) is in the range from about 0.5 to about 15 lb/$ft^3$; and the weight ratio of burnables/metal in the load is in the range from about 0.1 to about 2.

* * * * *